United States Patent [19]

Hutzler et al.

[11] 4,136,022

[45] Jan. 23, 1979

[54] NESTABLE SIFTER

[75] Inventors: Lawrence R. Hutzler, Long Beach, N.Y.; Falle Uldall, Roskilde, Denmark

[73] Assignee: Hutzler Manufacturing Company, Inc., Canaan, Conn.

[21] Appl. No.: 876,705

[22] Filed: Feb. 10, 1978

Related U.S. Application Data

[63] Continuation of Ser. No. 662,044, Feb. 27, 1976, abandoned.

[51] Int. Cl.[2] ..... B07B 1/02

[52] U.S. Cl. ..... 209/357; 206/515; 209/282

[58] Field of Search ..... 209/357, 352, 408, 374, 209/282; 206/515, 519, 520

[56] References Cited

U.S. PATENT DOCUMENTS

| | | | |
|---|---|---|---|
| 971,875 | 10/1910 | Andrews, Jr. | 209/357 |
| 1,118,927 | 12/1914 | Foster | 209/357 |
| 2,326,762 | 8/1943 | Collier | 209/357 |
| 2,592,850 | 4/1952 | Barbery | 209/357 |
| 2,803,375 | 8/1957 | Meshberg | 206/515 X |
| 3,415,376 | 12/1968 | Smith et al. | 209/357 X |
| 3,627,128 | 12/1971 | Ostrowsky | 209/357 X |

FOREIGN PATENT DOCUMENTS

| | | | |
|---|---|---|---|
| 1419903 | 10/1965 | France | 206/519 |
| 430048 | 6/1935 | United Kingdom | 209/357 |

*Primary Examiner*—Morris O. Wolk
*Assistant Examiner*—Arnold Turk
*Attorney, Agent, or Firm*—Fitzpatrick, Cella, Harper & Scinto

[57] ABSTRACT

A sifter, shaped to nest within a similarly shaped sifter, includes a tapered, hollow body, a handle connected to the body and extending outwardly therefrom, and an actuating mechanism extending along the outer surface of the body for driving an agitator positioned within the body.

13 Claims, 5 Drawing Figures

NESTABLE SIFTER

This is a continuation, of application Ser. No. 662,044 filed Feb. 27, 1976, now abandoned.

BACKGROUND OF THE INVENTION

1. Field of the Invention

This invention relates to sifters for sifting granular or powdered material such as flour, and more particularly to a construction which permits a plurality of such sifters to nest relative to one another.

2. Description of the Prior Art

Prior art sifters are generally made of sheet metal and, to facilitate manufacture, the body is cylindrical in shape. A handle is separately constructed and then fastened to the body, generally at its top and bottom. A screen and agitator are positioned within the body and an actuating mechanism is connected thereto for moving the agitator.

These prior art sifters are unsatisfactory for several reasons. It can readily be appreciated that the ability to nest is useful in reducing the space occupied by a plurality of sifters, and thus the cost of shipping and storing same. Nested sifters also take up less shelf space in establishments, such as bakeries or restaurants, which use many sifters. However, it is impossible to nest prior art sifters due to their cylindrical shape and their handle construction. Additionally, fabrication from sheet metal is disadvantageous since the useful life of such sifters is reduced by rusting. Finally, in order to adapt a prior art sifter to deposit sifted material into a conventional measuring cup without spillage, the diameter of the sifter was reduced and this in turn reduced its volumetric capacity.

U.S. Pat. No. 2,326,762 discloses a sifter designed to retain a large volumetric capacity but which is adapted for use with conventional measuring cups. This is achieved by providing a large diameter cylindrical body containing an agitator and adding thereto a tapered funnel having an upper diameter approximating that of the body and a lower diameter approximating that of a conventional measuring cup. However, since the actuating mechanism for the agitator extends along the inner surface of the body, sifters of this type cannot nest.

U.S. Pat. No. 3,415,376 discloses a molded plastic sifter which overcomes the rusting problem of sheet metal sifters. However, the hourglass shape of the sifter body and an actuating mechanism which extends between the agitator and the lower end of the handle, prevents nesting.

SUMMARY OF THE INVENTION

The present invention avoids the above-discussed disadvantages of the prior art by providing a sifter of molded construction which is shaped to permit nesting and which also may be used with a conventional measuring cup.

According to one aspect of the invention there is provided, a sifter having a hollow body, a screen and an agitator positioned within the hollow body near its lower end, when viewed in its normal operating position, a handle connected to the hollow body near its upper end and extending away from the body at its distal end, and an actuating mechanism for driving the agitator. The actuating mechanism extends along the outer surface of the body and is connected at one end to the agitator and at the other end to either the outer surface of the body or to the handle. A stop or abutment is also provided to limit the movement of the actuating mechanism, and thereby the agitator, in one direction.

The body is shaped to taper downwardly toward the screen and this feature, together with the absence of a lower connection between the handle and the body, permits a plurality of such sifters to be nested. In addition, the tapered shape helps to funnel the material being sifted down toward the agitator.

It is also preferred that the sifter components, except perhaps the screen, be fabricated from molded plastic in order to eliminate rusting problems.

There has thus been outlined rather broadly the more important features of the present invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that this invention may be utilized as a basis for designing other structures for carrying out the several purposes of this invention. It is therefore important that the claims be regarded as including such equivalent constructions as do not depart from the spirit and scope of the invention.

BRIEF DESCRIPTION OF THE DRAWINGS

One embodiment of the invention has been chosen for purposes of illustration and description and is shown in the accompanying drawings forming a part of the specification, wherein.

DETAILED DESCRIPTION OF THE INVENTION

Figure 1:
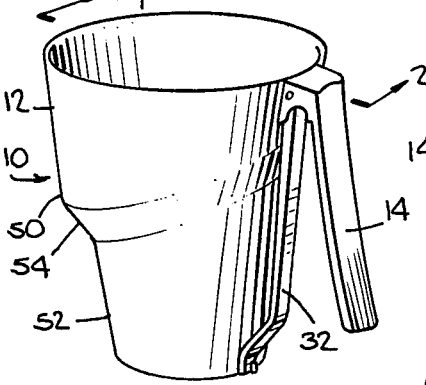
FIG. 1 is a perspective view of a sifter embodying the present invention.
Figure 2:
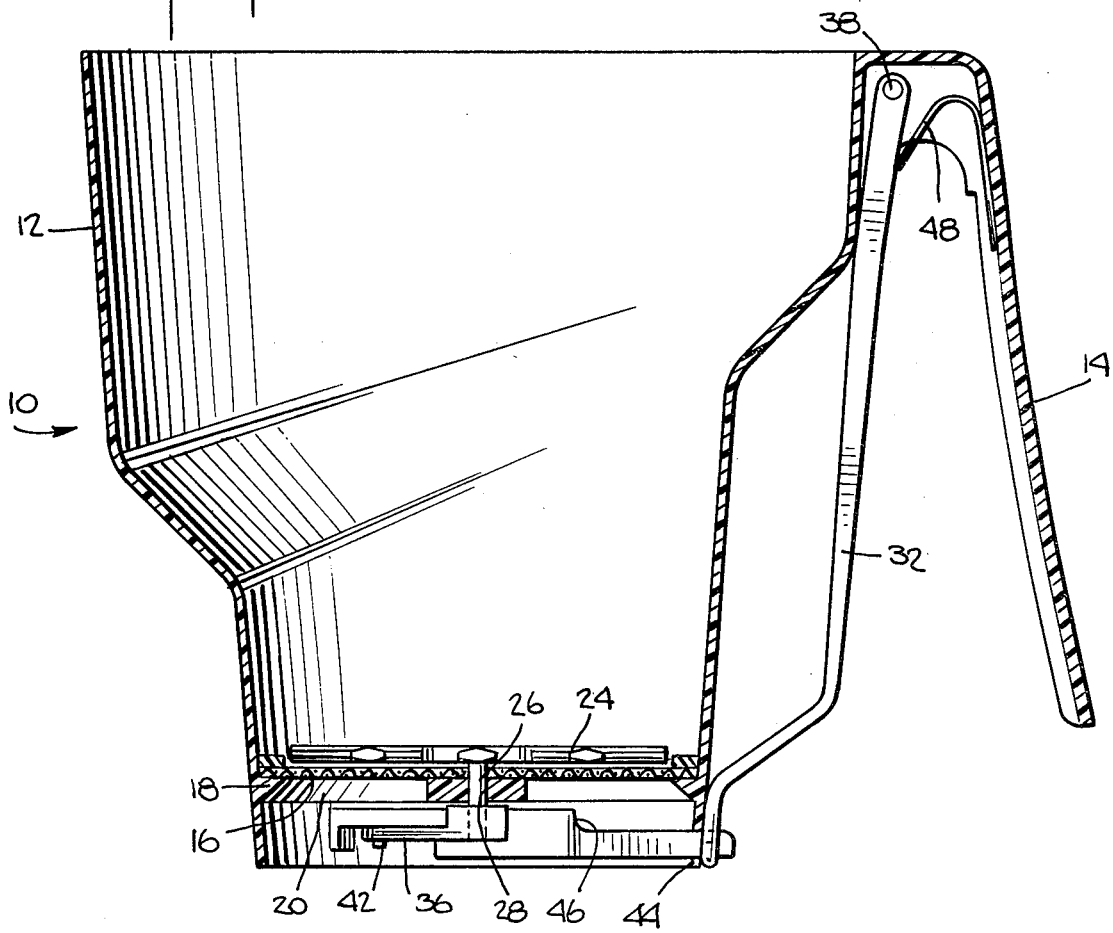
FIG. 2 is a cross-sectional view taken along lines 2—2 of FIG. 1.
Figures 3, 4:
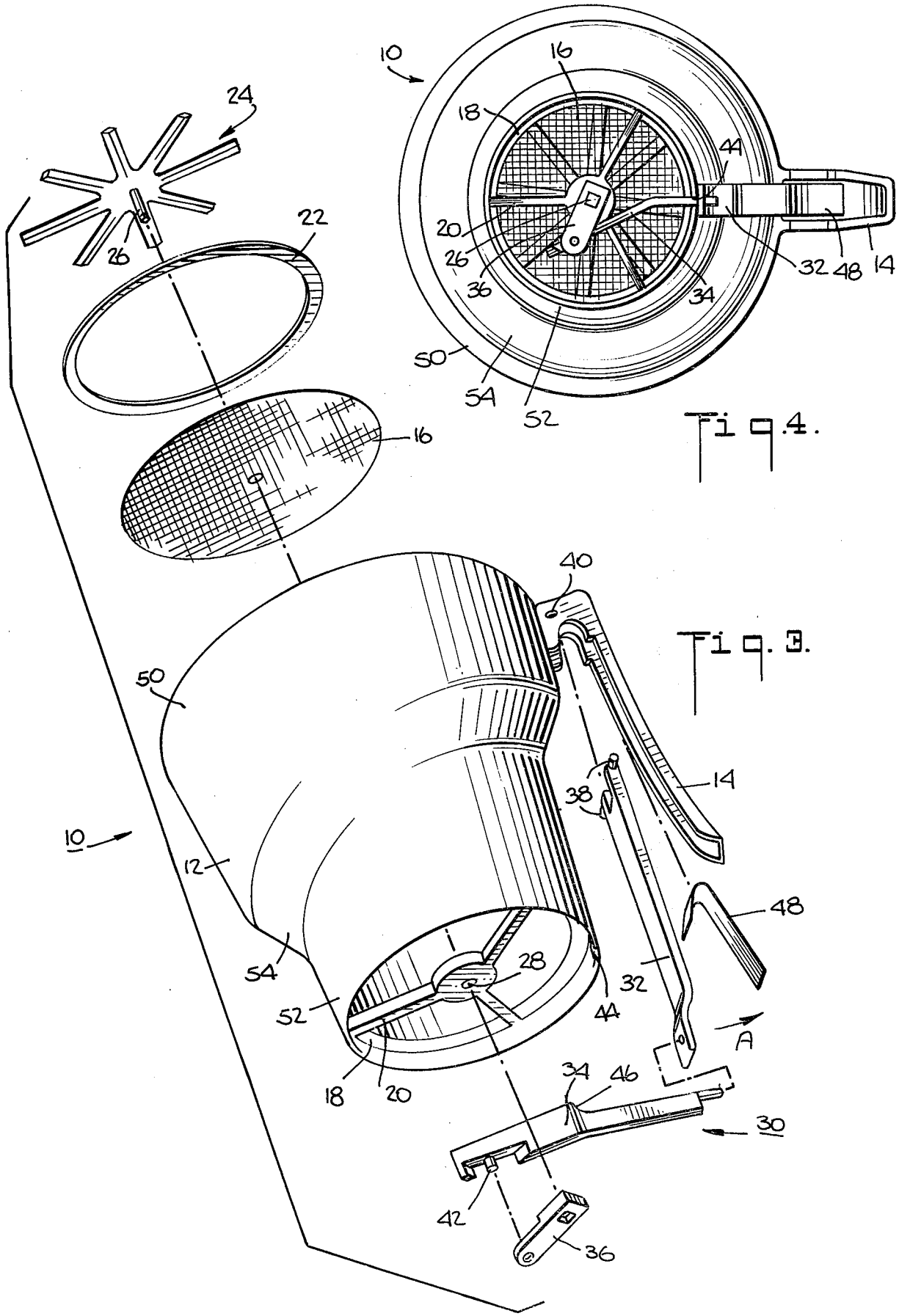
FIG. 3 is an exploded perspective view of the sifter.
FIG. 4 is a bottom plan view showing the actuating mechanism.

As shown in FIGS. 1–3, the invention is embodied in a sifter 10 having a generally tapered configuration. The sifter includes a hollow body 12 and a handle 14 connected to the body near the top of the sifter and extending outwardly and downwardly therefrom so that its distal end is spaced from the body. The body 12 and handle 14 may be integrally formed by injection molding, for example. A sifter screen 16 is positioned within body 12 in engagement with an annular lip 18 and a support 20 which together form part of the body 12, and a molded ring 22 is fixed in position adjacent screen 16 to hold it in place. A molded rotor or agitator 24 having a plurality of radially extending blades and a central shaft 26 is positioned above screen 16, the shaft extending through an aperture 28 formed in support 20. The blades of the rotor are preferably bevelled to direct the sifter material through the screen 16.

As best shown in FIGS. 3 and 4, an actuating mechanism is connected between shaft 26 and handle 14. The actuating mechanism includes an actuating arm 32, a connecting rod 34 and a crank arm 36, all of which are preferably molded components. The arm 32 has a pair of pins 38 formed at its upper end which are snap fitted into a pair of aperture 40 formed in the handle 14. Crank arm 36 is connected to a squared-off end of shaft 26 and is frictionally fitted onto a pin 42 formed on connecting rod 34 which, in turn, extends through a slit 44 in body 12 and is connected to the lower end of arm 32. An abutment surface or stop 46 is also formed on rod 34 to limit the amount of rotation of rotor 16 in one direction, as will later be described. Finally, a leaf spring 48 is positioned between handle 14 and arm 32 to bias the lower end of the arm into engagement with the outer surface of body 12 thereby to limit the extent of rotation in the opposite direction.

While the actuating mechanism has been disclosed as including an actuating arm pivotally connected to the handle and biased by a spring, it is also within the scope of the invention to use flexible spring metal which, when bent at its upper end along the inner contour of the handle, simultaneously performs a hinging and a biasing function.

In operation, pivotal movement of the arm 32, in the direction indicated by arrow A (FIG. 3), due to the application of manual force while the handle 14 and arm 32 are grasped, causes rotation of rotor 24 until the stop 46 engages the inner surface of the body 12. Upon release of arm 32, the spring 46 causes the arm to return to its initial position and rotor 24 is rotated in the direction opposite to that of its initial rotation. By alternately actuating and releasing the arm 32, oscillating movement is achieved and the material within the body is sifted through screen 16.

Referring particularly to FIGS. 1 and 3, body 12 preferably includes three segments 50, 52 and 54 which all taper downwardly in the direction of screen 16. Upper segment 50 has a top end of circular cross-section and a cross-sectional area throughout its entire length which is greater than that of either of the other segments. Lower segment 52 has a bottom end which is also of circular cross-section to accommodate rotor 24 positioned therein. Intermediate segment 54 has a greater taper than the upper or lower segments and merges at its top and bottom ends with the bottom of the sifter segment 50 and the top of the lower segment 52 respectively. Thus segment 54 sharply reduces the cross-sectional area between the upper and lower segments and thereby interrupts any continuity of taper between segments 50 and 52.

In order for a sifter to be used with a conventional measuring cup, the bottom end should have a diameter of between 2.5 and 3.5 inches, preferably about 3 inches, to assure that all of the sifted material falls into the cup. As stated previously, a cylindrical body having a small diameter substantially reduces the volumetric capacity of the sifter and also prevents nesting. At the same time, a frusto-conical sifter body does not greatly increase the volumetric capacity. However, the body contour described above does substantially increase the volumetric capacity and is also particularly adapted for use with conventional measuring cups. While the lower segment provides the necessary diameter to prevent spillage, the intermediate and upper segments increase the cross-sectional area toward the top end of the sifter, thereby increasing the overall volumetric capacity.

Figure 5:
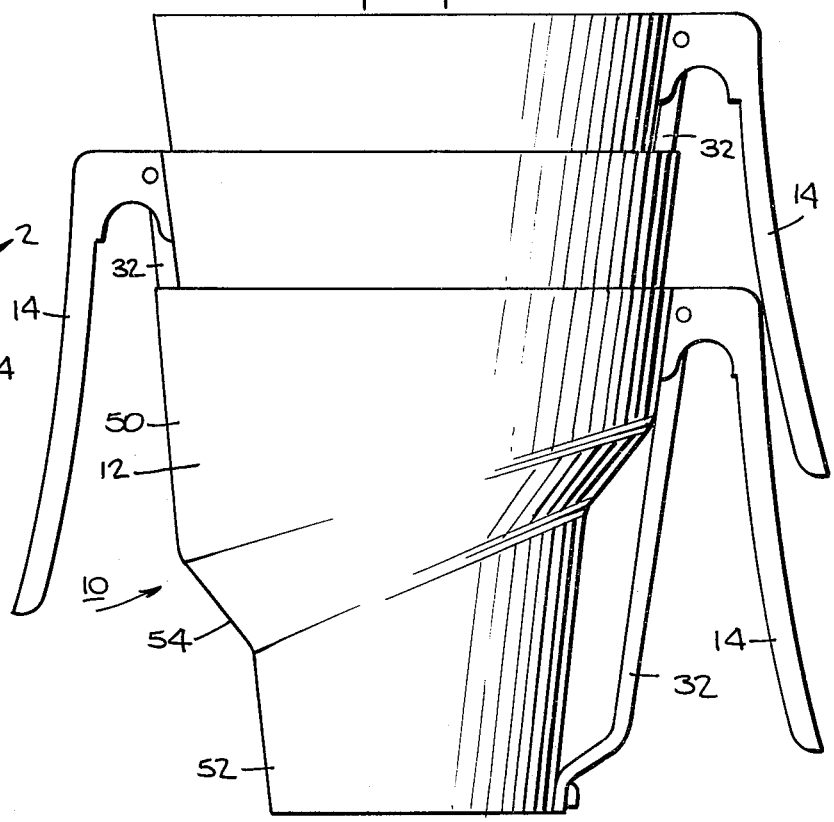
FIG. 5 is a side elevational view of a plurality of nested sifters.

As best seen in FIG. 5, it will readily be appreciated that the ability to nest results from the interrelationship between the overall tapered shape of the body 12 and the absence of a lower connection between the body and handle 14. The cross-sectional area of upper segment 50 is large enough to accommodate therein the lower and intermediate segments 52, 54 as well as the lower end of an arm 32 from a second sifter; the second sifter wedging against the tapered inner surface of body 12 while its handle 14 extends outwardly away from any possible interference with nesting.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A sifter for sifting granular or powdered material such as flour comprising a hollow body member formed with a first opening defining a bottom end and a second opening defining a top end, said body member including an upper portion which tapers inwardly toward the bottom end, a lower portion which also tapers inwardly to the bottom end and means interconnected between said upper and lower portions for sharply reducing the cross-sectional area defined by said body member between said portions and thereby interrupting any continuity of inward taper between said upper and lower portions, a screen positioned within said lower portion near the bottom end, an agitator positioned within said lower portion above said screen, a handle member connected at one end to the outer surface of said upper portion near the top end, the other end of said handle member being spaced from said body member, and actuating means connected to one of said members and to said agitator for actuating said agitator, wherein said actuating means extends between said body and handle members and in alignment with the taper of said upper portion and is spaced from said lower portion to facilitate manual actuation, and wherein said body member is contoured to nest therein at least the lower portion of an identical sifter.

2. A sifter according to claim 1, wherein said body and handle members are of a molded, integral construction.

3. A sifter according to claim 1, wherein said agitator is a rotor having a plurality of radially extending blades.

4. A sifter according to claim 1, wherein said bottom end has a circular cross-section with a diameter of the order of between 2.5 and 3.5 inches.

5. A sifter according to claim 1, wherein said means interconnected between said upper and lower portions is an intermediate portion having an inward taper greater than that of either said upper or lower portions to sharply reduce the cross-sectional area defined by said body member between said upper and lower portions.

6. A sifter according to claim 1, wherein the depth of said upper portion is greater at the side opposite said handle member than it is adjacent said handle member.

7. A sifter according to claim 1, wherein said actuating means includes an actuating arm connected to said handle member adjacent to the outer surface of said body member.

8. A sifter according to claim 7, wherein said actuating means further includes means interconnected between said agitator and said actuating arm.

9. A sifter for sifting granular or powdered material such as flour comprising a hollow body member formed with a first opening defining a bottom end and a second opening defining a top end, said body member including an upper portion which tapers inwardly toward the bottom end, a lower portion which also tapers inwardly to the bottom end and an intermediate portion interconnected between said upper and lower portions having an inward taper greater than that of either said upper or lower portions for sharply reducing the cross-sectional area defined by said body member between said upper and lower portions and thereby interrupting any continuity of inward taper between said upper and lower portions, a screen positioned within said lower portion near the bottom end, a rotor positioned within said lower portion above said screen, a handle member connected at one end to the outer surface of said upper portion near the top end, the other end of said handle member being spaced from said body member, and actuating means including an actuating arm connected to one of said members and operatively connected to said rotor for actuating said rotor, wherein said actuating arm extends between said body and handle members and in alignment with the taper of said upper portion and is spaced from said lower portion to facilitate manual actuation, and wherein said body member is contoured to nest therein at least the lower portion of an identical sifter.

10. A sifter according to claim 9, wherein said body and handle members are of a molded, integral construction.

11. A sifter according to claim 9, wherein said actuating means further includes means interconnected between said rotor and said actuating arm.

12. A sifter according to claim 9, wherein said body and handle members are of molded, integral construction.

13. A sifter according to claim 9, wherein the depth of said upper portion is greater at the side opposite said handle member than it is adjacent said handle member.

* * * * *